US011352225B2

(12) United States Patent
Matsumoto

(10) Patent No.: US 11,352,225 B2
(45) Date of Patent: Jun. 7, 2022

(54) IMAGE FORMING APPARATUS

(71) Applicant: CANON KABUSHIKI KAISHA, Tokyo (JP)

(72) Inventor: Shinichiro Matsumoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/921,632

(22) Filed: Jul. 6, 2020

(65) Prior Publication Data

US 2021/0009368 A1 Jan. 14, 2021

(30) Foreign Application Priority Data

Jul. 8, 2019 (JP) ..... JP2019-127063

(51) Int. Cl.

| | |
|---|---|
| ***B65H 1/00*** | (2006.01) |
| ***B65H 1/04*** | (2006.01) |
| ***B41J 13/00*** | (2006.01) |
| ***G03G 15/00*** | (2006.01) |

(52) U.S. Cl.

CPC ..... *B65H 1/04* (2013.01); *B41J 13/0045* (2013.01); *G03G 15/6555* (2013.01); *B65H 2511/12* (2013.01)

(58) Field of Classification Search

CPC ..... B65H 1/00; B65H 2405/1116; B65H 2405/112; B65H 2405/113; B65H 2405/114; B65H 2511/10; B65H 2511/12; B65H 2701/1131

See application file for complete search history.

(56) References Cited

U.S. PATENT DOCUMENTS 5,743,522 A * 4/1998 Rubscha ..... B65H 1/04 221/6
5,826,156 A * 10/1998 Natsume ..... G03G 15/6514 399/389
6,070,048 A * 5/2000 Nonaka ..... B65H 1/00 399/376
9,555,985 B2 * 1/2017 Kimura ..... H04N 1/00663

FOREIGN PATENT DOCUMENTS

JP H11-130271 A 5/1999
JP 2009-292594 A 12/2009
JP 2010-111512 A 5/2010

* cited by examiner

*Primary Examiner* — Thomas A Morrison
(74) *Attorney, Agent, or Firm* — Canon U.S.A., Inc. I.P. Division

(57) ABSTRACT

An image forming apparatus includes a stack portion on which a sheet is to be stacked, a regulating portion, a first detection device which includes a rotary variable resistor, a second detection, and a control unit. The regulating portion regulates a position of an edge of the stacked sheet. The first detection device outputs a detection signal based on the rotary variable resistor. The rotary variable resistor rotates in accordance with the sheet edge position regulated by the regulating portion. The second detection device detects presence or absence of the stacked sheet. The control unit calculates a calculated sheet width of the stacked sheet based on the output detection signal. The control unit sets the calculated sheet width after a first predetermined time has elapsed since the second detection device detects that the sheet is stacked on the stack portion as a detected sheet width of the stacked sheet.

12 Claims, 10 Drawing Sheets

FIG. 6A
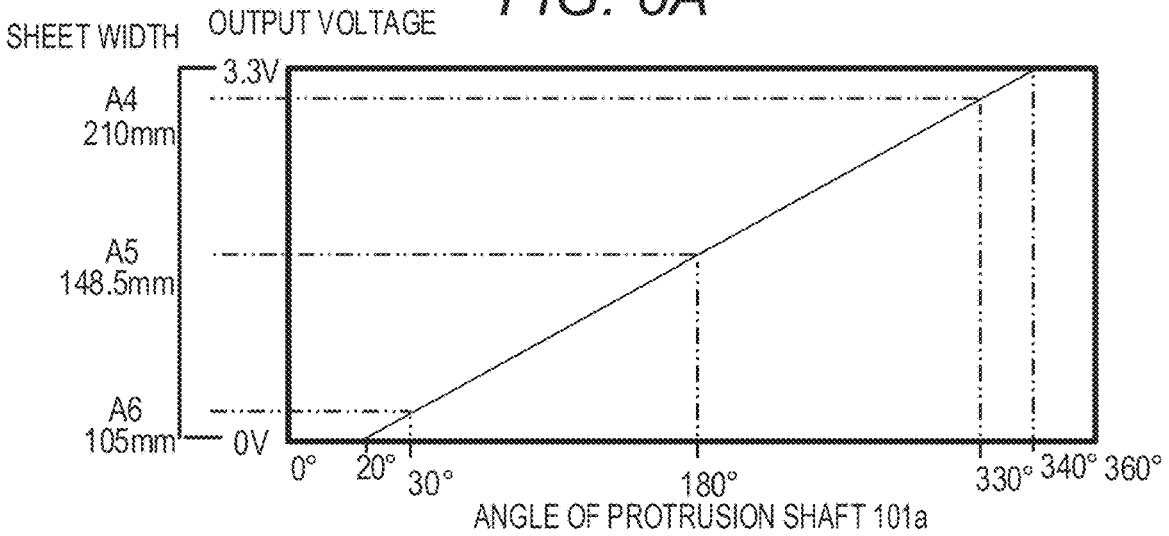
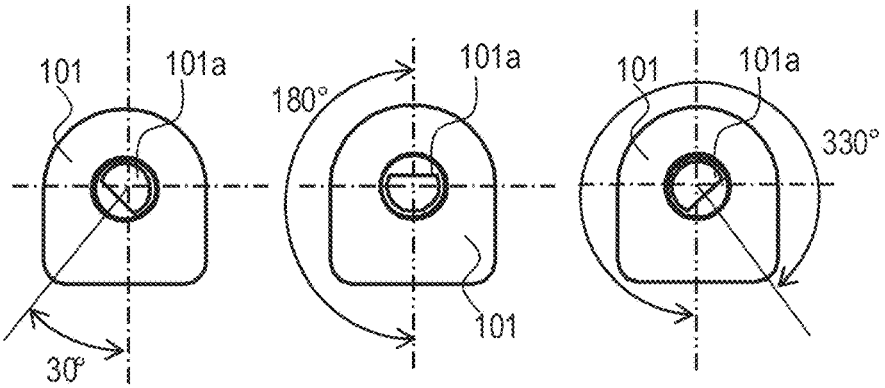
FIG. 6B FIG. 6C FIG. 6D
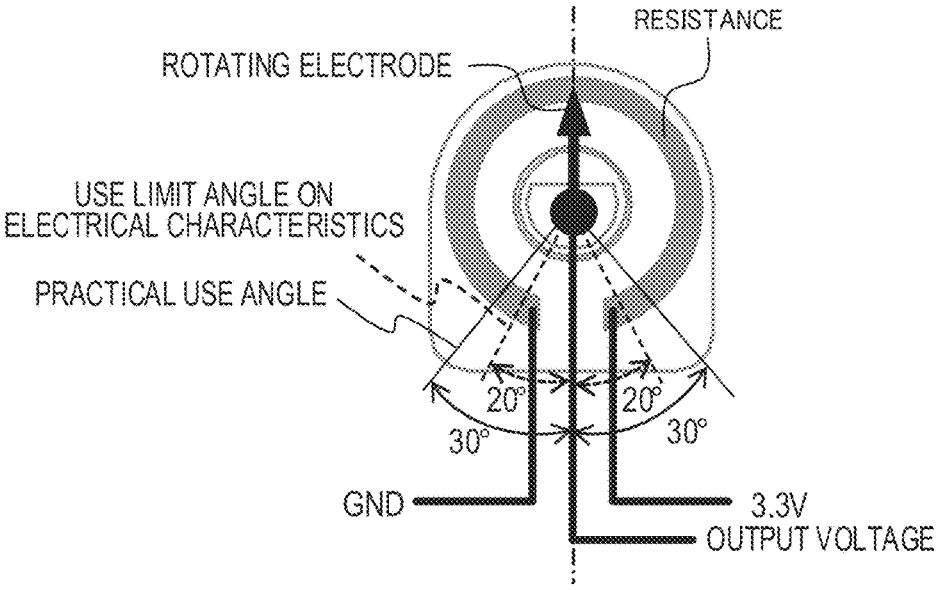
FIG. 6E

IMAGE FORMING APPARATUS

BACKGROUND OF THE DISCLOSURE

Field of the Disclosure

The present disclosure relates to an image forming apparatus.

Description of the Related Art

Various sizes of sheets are used in an image forming apparatus. A sheet-width detector configured to detect a size of a sheet is mounted to a feed tray configured to receive a sheet for the image forming apparatus. As a method of detecting a sheet width, which is used for the sheet-width detector, for example, the following method is proposed in Japanese Patent Application Laid-Open No. H11-130271. Specifically, regulating members are provided to a feed tray, and are configured to regulate movement of a sheet, which is placed in the feed tray while being sandwiched in a sheet width direction, in the sheet width direction by being brought into abutment against the sheet. Positions of the regulating members, which are brought into abutment against edges of the sheet in the width direction, are transmitted to a variable resistor provided to a sheet-width sensor via rack members and a pinion gear, and a resistance value of the variable resistor is changed in accordance with the positions of the regulating members. Then, the sheet-width detector detects the sheet width of the sheet placed in the feed tray based on a voltage corresponding to the resistance value of the variable resistor, which has been changed in accordance with the positions of the regulating members.

SUMMARY OF THE DISCLOSURE

In an image forming apparatus including a sheet-width detector mounted to the feed tray, when a print job is input from a host computer or the like, image formation conditions are set based on information of the sheet width detected by the sheet-width detector, and a printing operation is performed. The "image formation conditions" as used here include secondary processing conditions for a graphic image such as a lateral width of a graphic image and an enlargement/reduction ratio of a graphic image. Further, in an electrophotographic image forming apparatus, the image formation conditions include a wide variety of conditions such as a processing speed for image formation, an output voltage value of a high-voltage power supply, and a set temperature of a fixing device given at the time of image formation. Further, a display portion of the image forming apparatus performs notification of sheet information to a user based on information of the sheet width detected by the sheet-width detector.

The present disclosure has been made under such circumstances, and works towards reducing erroneous detection of a sheet width of a sheet placed in a feed tray.

According to an aspect of the present disclosure, an image forming apparatus includes a stack portion on which a sheet is to be stacked, a regulating portion configured to regulate a position of an edge of the stacked sheet, a first detection device which includes a rotary variable resistor and is configured to output a detection signal based on the rotary variable resistor, wherein the rotary variable resistor is configured to rotate in accordance with the sheet edge position regulated by the regulating portion, a second detection device configured to detect presence or absence of the stacked sheet, and a control unit configured to calculate a calculated sheet width of the stacked sheet based on the output detection signal, wherein the control unit sets the calculated sheet width of the sheet calculated based on the detection signal after a first predetermined time has elapsed since the second detection device detects that the sheet is stacked on the stack portion as a detected sheet width of the stacked sheet.

Further features of the present disclosure will become apparent from the following description of exemplary embodiments with reference to the attached drawings.

BRIEF DESCRIPTION OF THE DRAWINGS

FIG. 6A, FIG. 6B, FIG. 6C, FIG. 6D, and FIG. 6E show an operation of the sheet width sensor of the first to third embodiments.

DESCRIPTION OF THE EMBODIMENTS

Now, detailed description is made of embodiments of the present disclosure with reference to the drawings.

First Embodiment

[Configuration of Image Forming Apparatus]

Figure 1:
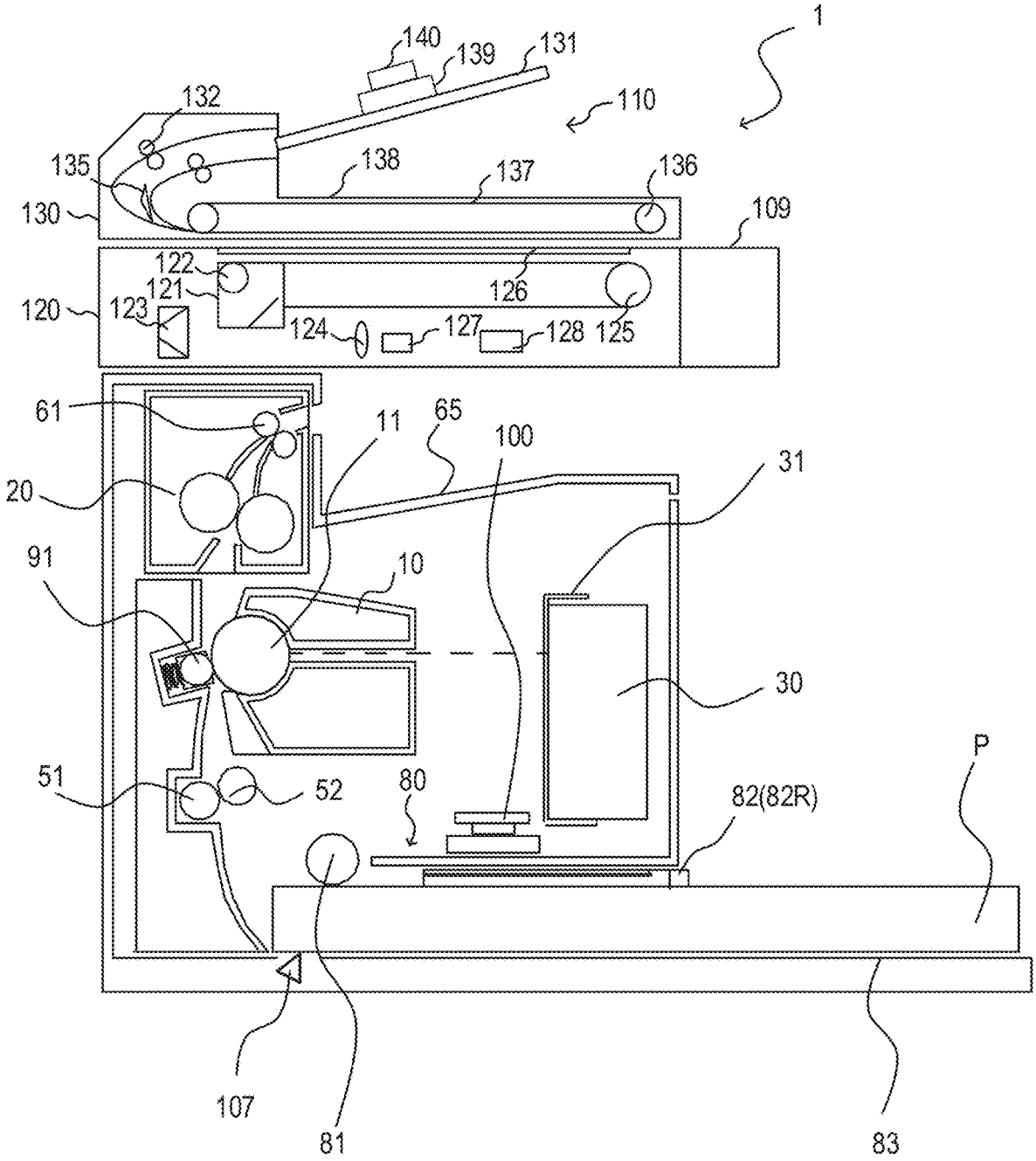
FIG. 1 is a sectional view for illustrating a configuration of an image forming apparatus according to first to third embodiments.

First, an overall configuration of an image forming apparatus to which the present disclosure is applied is described with reference to FIG. 1. FIG. 1 is a sectional view for illustrating a configuration of a laser beam printer 1 (hereinafter referred to as "printer 1") corresponding to one mode of the image forming apparatus according to this embodiment.

In the printer 1 illustrated in FIG. 1, a feeding portion 80 configured to receive a sheet P, which is a recording material, is arranged in a lowermost stage. A feed tray 83 is provided to the feeding portion 80, and allows a user to directly stack the sheet P. The configuration of the feeding portion of this type is called "open tray type". On an upper left side of the feeding portion 80 in FIG. 1, a registration roller 51 and a registration counter roller 52 are arranged. The registration roller 51 and the registration counter roller 52 are configured to align a position of a leading edge of the sheet P, which is conveyed from the feeding portion 80, and convey the sheet P to a transfer roller 91.

Above the feeding portion 80 in FIG. 1, a sheet-width detection unit 100 and a laser scanner unit 30 are arranged. The sheet-width detection unit 100 is configured to detect a width, which is a length orthogonal to a conveyance direction (direction from the right to the left of FIG. 1) of the sheet P. The laser scanner unit 30 is configured to form an electrostatic latent image on a photosensitive drum 11. In FIG. 1, a scanner frame 31 is arranged on a left side of the laser scanner unit 30. The laser scanner unit 30 is fixed to the scanner frame 31. On a left side of the scanner frame 31 in FIG. 1, a process cartridge 10 is arranged. The process cartridge 10 includes the photosensitive drum 11 and a developing device (not shown). The photosensitive drum 11 is exposed to a light beam emitted from the laser scanner unit 30 in accordance with image information to form an electrostatic latent image thereon. The developing device is configured to develop the electrostatic latent image formed on the photosensitive drum 11 to form a toner image. In FIG. 1, on a left side of the process cartridge 10, the transfer roller 91 configured to transfer the toner image formed on the photosensitive drum 11 onto the sheet P is provided at such a position as to be opposed to the process cartridge 10. Further, in FIG. 1, above the process cartridge 10 and the transfer roller 91, a fixing unit 20 configured to fix the toner image, which has been transferred to the sheet P, on the sheet P is arranged. In FIG. 1, on an upper right side of the fixing unit 20, a delivery roller pair 61 configured to deliver the sheet P, which has been conveyed from the fixing unit 20, to a delivery tray 65 is provided. Further, a CPU 106 (see FIG. 7), which corresponds to a control unit, is included in a control portion (not shown) configured to control image formation to be performed on the sheet P, and is configured to collectively control an image formation operation of the printer 1.

Further, the printer 1 of the first embodiment includes a reading device 110. The reading device 110 includes an original conveying portion 130 and an original reading portion 120 provided at the top of the apparatus, and is configured to read an original. Further, an operation portion 109 is provided on a side surface portion of the original reading portion 120. The operation portion 109 includes, for example, a keyboard for allowing a user to input data to the printer 1 and a display portion for displaying information of various types.

In the original conveying portion 130 of the reading device 110, originals placed on an original placement table 131 are conveyed one by one by feed rollers 132 to an original table 126 of the original reading portion 120. The original is conveyed by an original conveying belt 137, which is driven by a motor 136 to rotate, to a predetermined position on the original table 126, and then is read by the original reading portion 120. After the original is read, a conveyance path of the original is changed by a flapper 135, and the motor 136 is reversely rotated to rotate the original conveying belt 137 in the opposite direction. As a result, the original is delivered to a delivery tray 138. Further, original regulating plates 139 and an original-width detection unit 140 are provided to the original placement table 131. The original regulating plates 139 are configured to regulate edges of the original in a width direction orthogonal to the conveyance direction of the original. The original-width detection unit 140 is configured to detect a width of the original, which is a length of the original in a direction orthogonal to the conveyance direction of the original.

Further, the original reading portion 120 has the following configuration for reading an original image of the original on the original table 126. An exposure lamp 122 installed on a first mirror base 121 irradiates the original on the original table 126 with light while moving in a longitudinal direction of the original (right-and-left direction of FIG. 1). Diffused light from the original generated through the irradiation with light by the exposure lamp 122 is reflected by mirrors installed on the first mirror base 121 and a second mirror base 123 and then reaches a lens 124. The first mirror base 121 and the second mirror base 123 are driven by a motor 125 to move. The image on the original is imaged on a light receiver of a CCD line sensor 127 via the first mirror base 121, the second mirror base 123, and the lens 124, and is subjected to photoelectric conversion by the CCD line sensor 127. A signal obtained as a result of the photoelectric conversion is processed by a signal processor 128 and output to the CPU 106 mentioned above.

[Image Formation Operation]

First, a user sets the sheet P in the feed tray 83, which corresponds to a stack portion configured to stack the sheet P of FIG. 1 therein, so as to perform the image formation on the sheet P. At this time, the user moves (slides) side regulating plates 82 (82R, 82L), which correspond to a regulation portion configured to regulate a magnitude of the width orthogonal to the conveyance direction of the sheet P, to positions in accordance with the width of the sheet P. Further, a sheet sensor 107 (second detection device) configured to detect presence or absence of the sheet P placed in the feed tray 83 is provided to the printer 1. When the sheet sensor 107 detects that the sheet P is placed in the feed tray 83, a printing operation described later can be performed. Meanwhile, when the sheet sensor 107 detects that the sheet P is not placed in the feed tray 83, the printing operation is suspended.

When a print job including, for example, a printing instruction and image information is input to the CPU 106 of the control portion from an external host computer (not shown) or the like, the printing operation on the sheet P is started. Through control of the CPU 106, the sheet P is first fed from the feed tray 83 by a feed roller 81, and is conveyed to the registration roller 51 and the registration counter roller 52. Further, in parallel with the conveyance control for the sheet P, the CPU 106 of the control portion controls the laser scanner unit 30 based on the image information to form an electrostatic latent image on the photosensitive drum 11, and controls the developing device to form a toner image on the photosensitive drum 11. Then, the CPU 106 controls the registration roller 51 and the registration counter roller 52 to rotate in synchronization with a timing of transferring the toner image formed on the photosensitive drum 11 onto the transfer roller 91 to thereby convey the sheet P to the transfer roller 91. In this manner, the sheet P is conveyed to a nip portion defined between the photosensitive drum 11 and the transfer roller 91, which are in abutment against each other. The toner image formed on the photosensitive drum 11 is transferred onto the sheet P at the nip portion. The toner image, which has been transferred onto the sheet P, is heated and pressurized by the fixing unit 20 including, for example, a fixing roller to be molten and fixed onto the sheet P. Then, the sheet P having the toner image fixed thereon is delivered by the delivery roller pair 61 to the delivery tray 65, and the image formation operation is completed.

[Configuration of Sheet Width Sensor]

Figure 2:
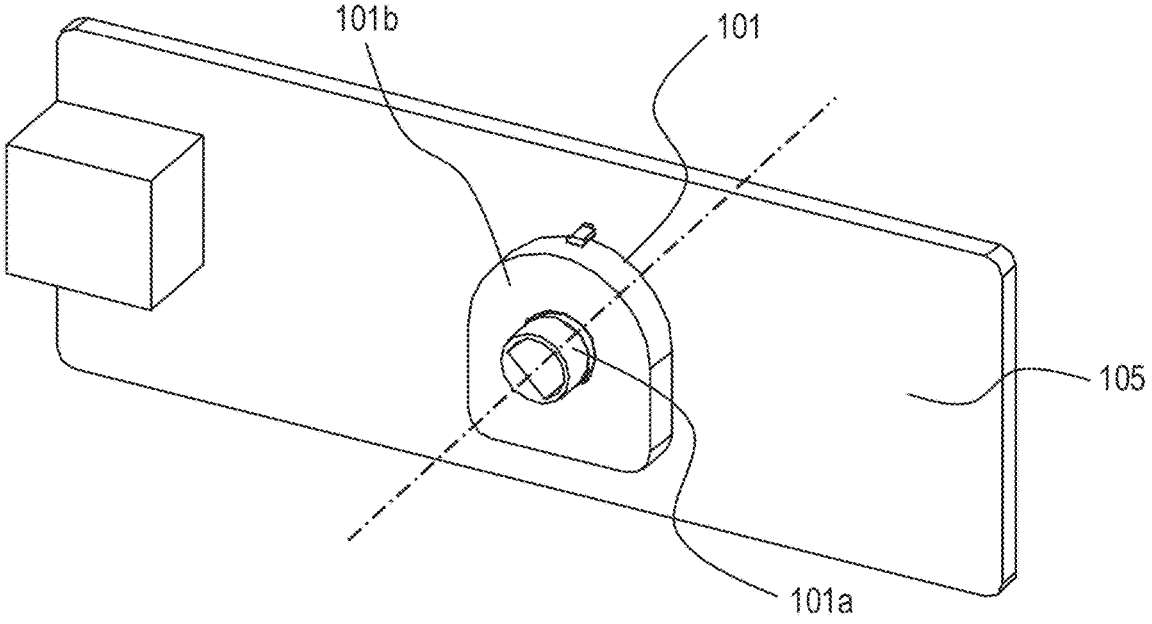
FIG. 2 is a perspective view for illustrating configurations of a sheet width sensor and a printed board of the first to third embodiments.

FIG. 2 is a perspective view for illustrating configurations of a sheet width sensor 101 (hereinafter referred to as "width sensor 101") and a printed board 105 in the sheet-width detection unit 100 illustrated in FIG. 1. The width sensor 101 is configured to detect the width of the sheet P received in the feed tray 83. The width sensor 101 is mounted onto the printed board 105. As illustrated in FIG. 2, the width sensor 101 (first detection device) includes a protrusion shaft 101*a* and a sensor main body 101*b*. The protrusion shaft 101*a* has a hole formed in a center, and is mounted so as to be rotatable with respect to the sensor main body 101*b*. Meanwhile, the sensor main body 101*b* includes a variable resistor of a rotary type, and is fixed onto the printed board 105 under an electrically connected state. The sensor main body 101*b* includes a resistance (not shown), and has a resistance value changed in accordance with a rotation angle of the protrusion shaft 101*a*. The width sensor 101 converts the resistance value of the variable resistor of the sensor main body 101*b* into a voltage corresponding to a detection signal, and outputs the voltage to the CPU 106 (see FIG. 7) of the control portion (not shown).

[Configuration of Sheet-Width Detection Unit]

Figure 3:
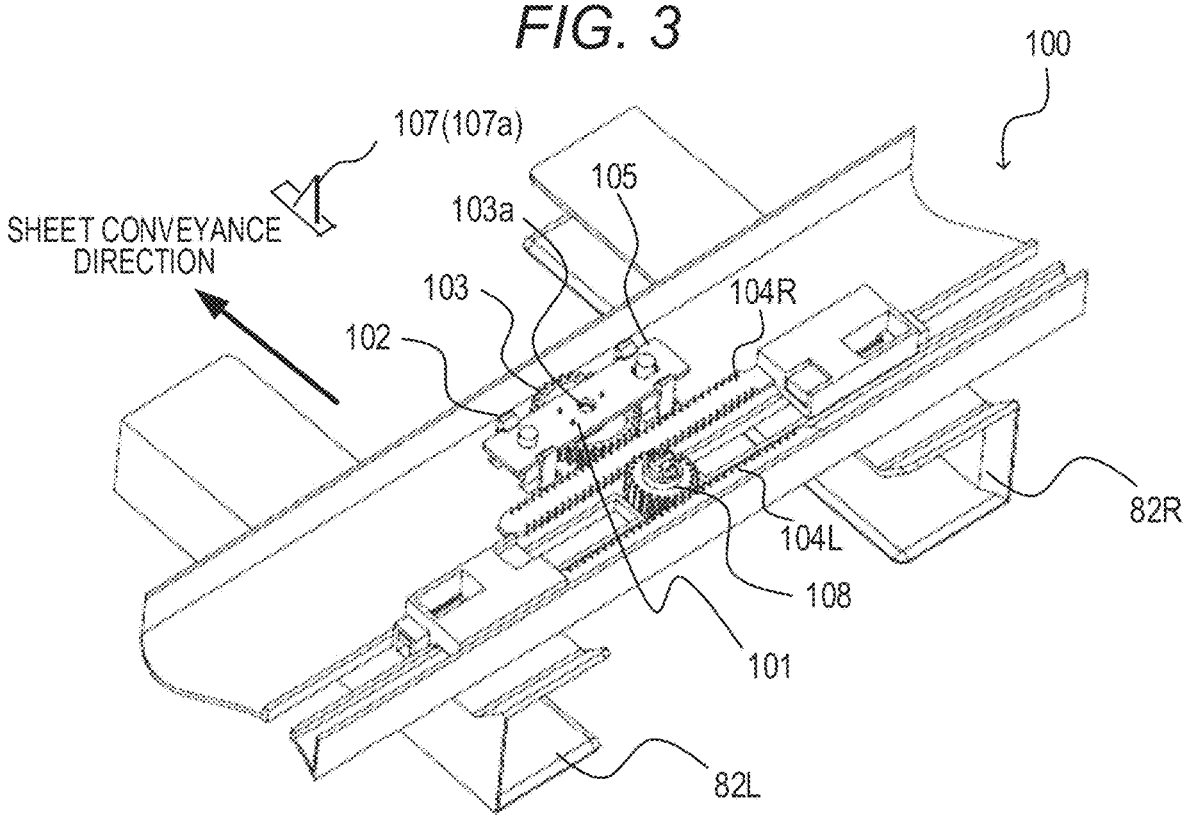
FIG. 3 is a perspective view for illustrating a configuration of a sheet-width detection unit of the first to third embodiments and a relationship between the sheet-width detection unit and side regulating plates.

FIG. 3 is a perspective view for illustrating a configuration of the sheet-width detection unit 100 and a relationship between the sheet-width detection unit 100 and the side regulating plates 82 (82L and 82R). FIG. 3 is a perspective view for illustrating the sheet-width detection unit 100 and the side regulating plates 82 (82L and 82R) when viewed from above on an upstream side of the feed tray 83 in the conveyance direction of the sheet P (sheet conveyance direction of FIG. 3). As illustrated in FIG. 3, the printed board 105, onto which the width sensor 101 is mounted, is mounted to a width sensor holder 102. Further, a sensor gear 103 configured to be rotated in accordance with a motion of the side regulating plate 82 (82R) is provided in abutment against the width sensor 101. The sensor gear 103 includes a rotary shaft 103*a*. The rotary shaft 103*a* is fitted to the hole (see FIG. 2) formed in the protrusion shaft 101*a* of the width sensor 101, and is rotatably mounted to the width sensor holder 102.

The side regulating plates 82 include a pair of right and left side regulating plates 82R (right side) and 82L (left side). The side regulating plates 82R (first regulating member) and 82L (second regulating member) are configured to regulate positions of one edge and another edge of edges of the sheet P, which is placed in the feed tray 83, in the width direction, respectively. Further, the side regulating plate 82R and a sensor rack 104R are coupled to each other, and the side regulating plate 82L and a sensor rack 104L are coupled to each other. Accordingly, the sensor racks 104L and 104R are configured to be movable in synchronization with sliding operations of the side regulating plates 82L and 82R, respectively. A pinion 108 is provided between the sensor racks 104L and 104R, and teeth of a gear of the pinion 108 are meshed with teeth formed on the sensor racks 104L and 104R. Thus, when one of the side regulating plates 82 (for example, 82R) is slid, one of the sensor racks 104 (for example, 104R) moves to rotate the pinion 108, thereby allowing another one of the sensor racks 104 (for example, 104L) to also slide in a symmetric manner. With such a configuration, through the sliding of one of the side regulating plates 82, the right and left sides of the sheet P, which is placed in the feed tray 83, in the width direction can be regulated at the same time.

Further, the sensor rack 104R has teeth formed on the pinion 108 side and the sensor gear 103 side, and the teeth are meshed with the teeth of the pinion 108 and the teeth of the sensor gear 103. Therefore, when the sensor rack 104R moves in synchronization with the sliding operation of the side regulating plate 82R, the sensor gear 103 also rotates in association with the movement of the sensor rack 104R.

As described above with reference to FIG. 1, the sheet sensor 107 is provided on a downstream side of the feed tray 83 in the conveyance direction of the sheet P. In FIG. 3, the sheet P is not placed in the feed tray 83, and hence a flag portion 107*a* (see FIG. 7) configured to detect presence or absence of the sheet P protrudes from a side surface of the feed tray 83.

Figure 4:
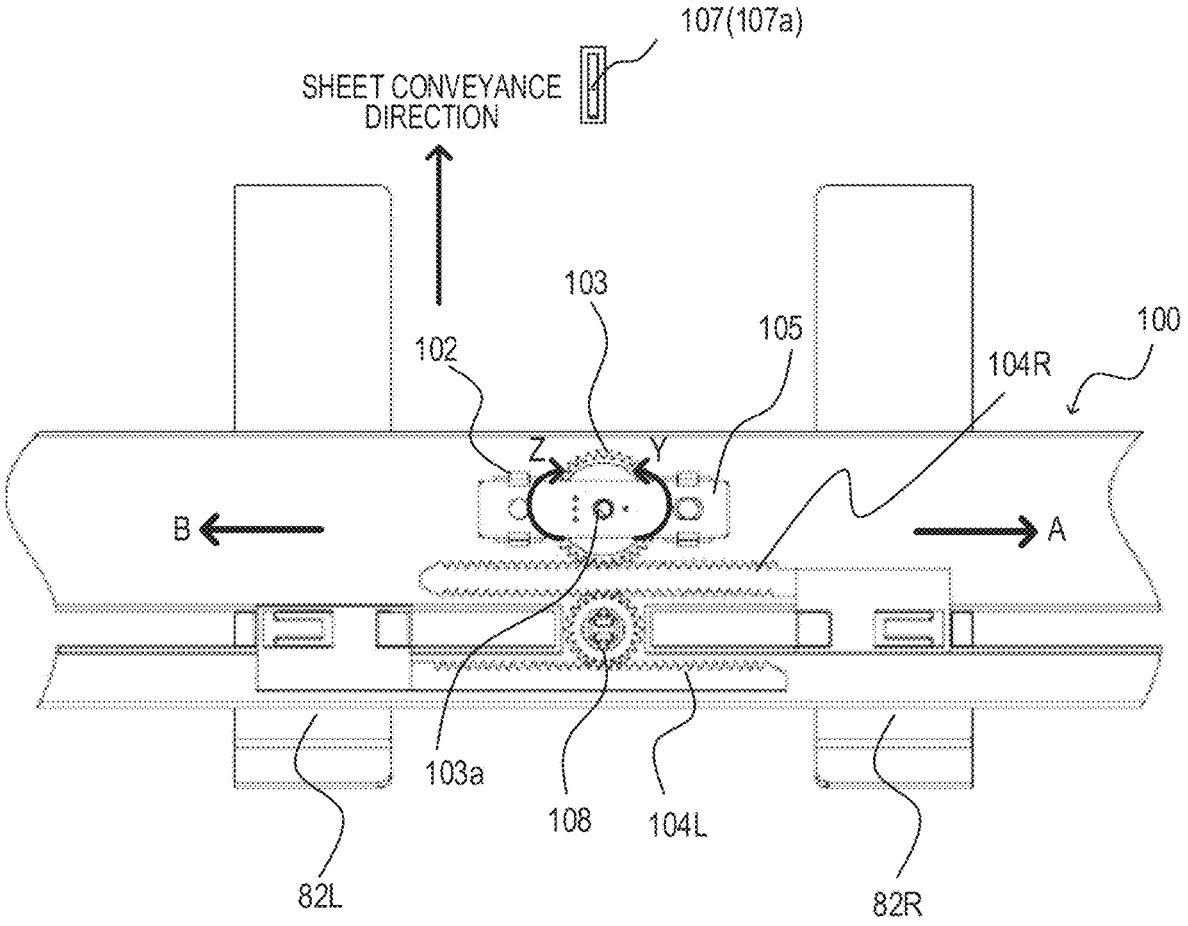
FIG. 4 is a top view for illustrating the configuration of the sheet-width detection unit of the first to third embodiments and the relationship between the sheet-width detection unit and the side regulating plates.

FIG. 4 is a top view of the sheet-width detection unit 100 and the side regulating plates 82 (82L and 82R) when viewed from above the feed tray 83. As illustrated in FIG. 4, the sensor gear 103 is mounted in abutment against the lower surface of the width sensor 101 (not shown in FIG. 4) of the printed board 105. The sensor gear 103 includes the rotary shaft 103*a* fitted to the hole formed in the protrusion shaft 101*a* (FIG. 2) of the width sensor 101, and is rotatably mounted to the width sensor holder 102. As mentioned above, the sensor racks 104L and 104R are coupled to the side regulating plates 82L and 82R, respectively. For example, when the side regulating plate 82R is slid in accordance with a width of the sheet P after the reception of the sheet P in the feed tray 83, the sensor rack 104R is also slid in association with the motion of the side regulating plate 82R. For example, when the side regulating plate 82R is slid in a direction A of FIG. 4 (rightward direction of FIG. 4), the sensor rack 104R is also slid in the direction A. At the same time, the sensor gear 103 is rotated in a direction Y of FIG. 4 (counterclockwise direction). Meanwhile, when the side regulating plate 82R is moved in a direction B of FIG. 4 (leftward direction of FIG. 4), the sensor rack 104R is also slid in the direction B. At the same time, the sensor gear 103 is rotated in a direction Z of FIG. 4 (clockwise direction).

[Operation of Sheet-Width Detection Unit]

Figure 5:
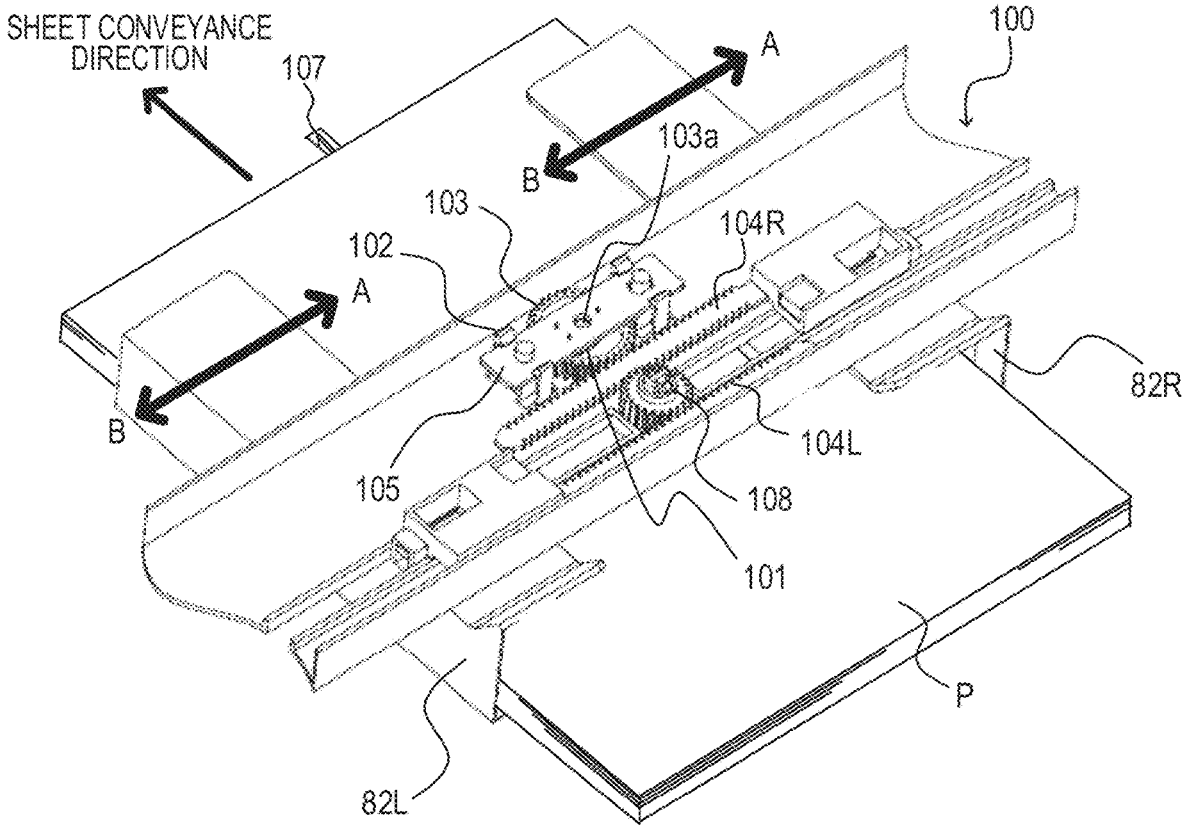
FIG. 5 is a perspective view for illustrating the configuration of the sheet-width detection unit of the first to third embodiments and the relationship between the sheet-width detection unit and the side regulating plates.

FIG. 5 is an explanatory view for illustrating an operation of the sheet-width detection unit 100 when the sheet P is set in the feed tray 83. FIG. 5 is a perspective view of the side regulating plates 82 and the sheet-width detection unit 100 when viewed from above on the upstream side of the feed tray 83 in the conveyance direction of the sheet P (sheet conveyance direction of FIG. 5) when the sheet P is placed in the feed tray 83. The width sensor 101 is installed in parallel to an upper surface of the sheet P placed between the side regulating plate 82L and the side regulating plate 82R. In FIG. 5, in order to set the sheet P in the feed tray 83, a user moves the side regulating plate 82R in the direction A indicated by the arrow of FIG. 5 or moves the side regulating plate 82L in the direction B indicated by the arrow of FIG. 5. Then, after the sheet P is set in the feed tray 83, the user moves the side regulating plate 82R in the direction B indicated by the arrow of FIG. 5 or moves the side regulating plate 82L in the direction A indicated by the arrow of FIG. 5, to thereby bring the side regulating plate 82R or the side regulating plate 82L to a position of abutment against a corresponding edge of the sheet P on the width side.

In FIG. 5, when the side regulating plate 82R is slid (moved) in the direction A indicated by the arrow, in association with the motion of the side regulating plate 82R, the sensor rack 104R coupled to and integrated with the side regulating plate 82R is also moved in the direction A indicated by the arrow. As the sensor rack 104R is moved in the direction A indicated by the arrow, the pinion 108 having the teeth meshed with the teeth formed on the sensor racks 104 is rotated, and the sensor rack 104L having the teeth meshed with the teeth of the pinion 108 is slid. As a result, the side regulating plate 82L is slid in the direction B, which is a direction symmetrical to a sliding direction of the side regulating plate 82R (operation direction). As the sensor rack 104R is moved in the direction A indicated by the arrow, the sensor gear 103 having the teeth meshed with the teeth formed on the sensor rack 104R is rotated in the counterclockwise direction of FIG. 5. With this, the protrusion shaft 101*a* (not shown in FIG. 5) of the width sensor 101 to which the rotary shaft 103*a* of the sensor gear 103 is fitted is also rotated in the counterclockwise direction. Then, the width sensor 101 converts a resistance value of a variable resistor of the sensor main body 101*b*, which is associated with an angle of the protrusion shaft 101*a*, into a voltage and outputs the voltage to the CPU 106 (see FIG. 7) of the control portion (not shown).

[Operation of Sheet Width Sensor]

FIG. 6A is a graph for showing a relationship between an angle of the protrusion shaft 101*a* of the width sensor 101 and a width of the sheet P. In FIG. 6A, the horizontal axis represents an angle (in degree (°)) of the protrusion shaft 101*a*, and the vertical axis represents an output voltage (in volt (V)) of the width sensor 101 and a sheet width (sheet type and sheet width of the sheet P) corresponding to the output voltage. It can be understood from FIG. 6A that the resistance value of the variable resistor is increased as the angle of the protrusion shaft 101*a* increases and that the output voltage of the width sensor 101 is also increased in proportion to the increase in resistance value. In the first embodiment, the output voltage is set so as to indicate that the width of the sheet P is equal to a width of A6 size (105 mm) when the angle of the protrusion shaft 101*a* is 300 and indicate that the width of the sheet P is equal to a width of A4 size (210 mm) when the angle is 330°. As described above, when the angle of the protrusion shaft 101*a* is linearly changed, the width of the sheet P can also be linearly detected.

FIG. 6B, FIG. 6C, and FIG. 6D are views for illustrating a state of the protrusion shaft 101*a* of the width sensor 101 when the angle of the protrusion shaft 101*a* is 30°, 180°, and 330°, respectively, and are illustrations of a state in which the width sensor 101 is viewed from the sensor gear 103 side in FIG. 5. For example, when the sheet P placed in the feed tray 83 in FIG. 5 has the A6 size, the protrusion shaft 101*a* of the width sensor 101 is in a state of assuming the position of FIG. 6B. In FIG. 5, when the side regulating plate 82R is slid to the position of the corresponding end portion of the sheet P in the width direction, the rotation angle of the protrusion shaft 101*a* is 30°. When the width of the sheet P is calculated based on the rotation angle of the protrusion shaft 101*a*, 105 mm, which corresponds to the width of the A6 size, is obtained as the width of the sheet P. When the side regulating plate 82R is slid in the direction A indicated by the arrow (rightward direction in FIG. 5) from a state of FIG. 5, the rotation angle of the protrusion shaft 101*a* is increased in accordance with a sliding amount to be changed from the rotation angle of FIG. 6B to that of FIG. 6D. With the change in rotation angle of the protrusion shaft 101*a*, the voltage output from the width sensor 101, which corresponds to the rotation angle of the protrusion shaft 101*a*, also increases. Thus, a larger width of the sheet P corresponding to the output voltage calculated by the CPU 106 is detected.

In FIG. 6A, the output voltage is not shown in a section in which the rotation angle of the protrusion shaft 101*a* falls within a range of from 0° to 20° and a section in which the rotation angle of the protrusion shaft 101*a* falls within a range of from 340° to 360°. This is because the above-mentioned sections are out of a use range of the width sensor 101 in electrical characteristics. FIG. 6E is a view for illustrating a configuration of the variable resistor of the width sensor 101. The width sensor 101 includes a resistance, which is the resistor, and a rotating electrode therein. The rotating electrode is configured to be rotated in accordance with the rotation angle of the protrusion shaft 101*a* of the width sensor 101, into which the rotary shaft 103*a* of the sensor gear 103 is fitted. The width sensor 101 outputs a voltage of 0 V (GND) when a rotation angle of the rotating electrode is 20 and outputs a voltage of 3.3 V when the rotation angle of the rotating electrode is 340°. In the width sensor 101, a practical use angle of the rotating electrode falls within a range of from 30 to 330 (=360°−30°). Further, in the width sensor 101, use limit angles in electrical characteristics are 20 and 340 (=360°−20°). When the rotation angle of the rotating electrode is less than 200 or larger than 340°, the voltage is not output.

Thus, in FIG. 6A, the rotation angle of the protrusion shaft 101*a*, which corresponds to the minimum width of a sheet P that can be detected by the width sensor 101, is set to 30°. Thus, a mechanical margin of 10° is set for the angle of 20°, which is the use limit angle of the width sensor 101 in electrical characteristics. Similarly, for a maximum width of the sheet P, the rotation angle of the protrusion shaft 101*a*, which corresponds to the maximum width of a sheet P that can be detected by the width sensor 101, is set to 330°. Thus, a mechanical margin of 10° is set for the angle of 340° which is the use limit angle of the width sensor 101 in electrical characteristics.

[System Configuration for Detection of Sheet Width]

Figure 7:
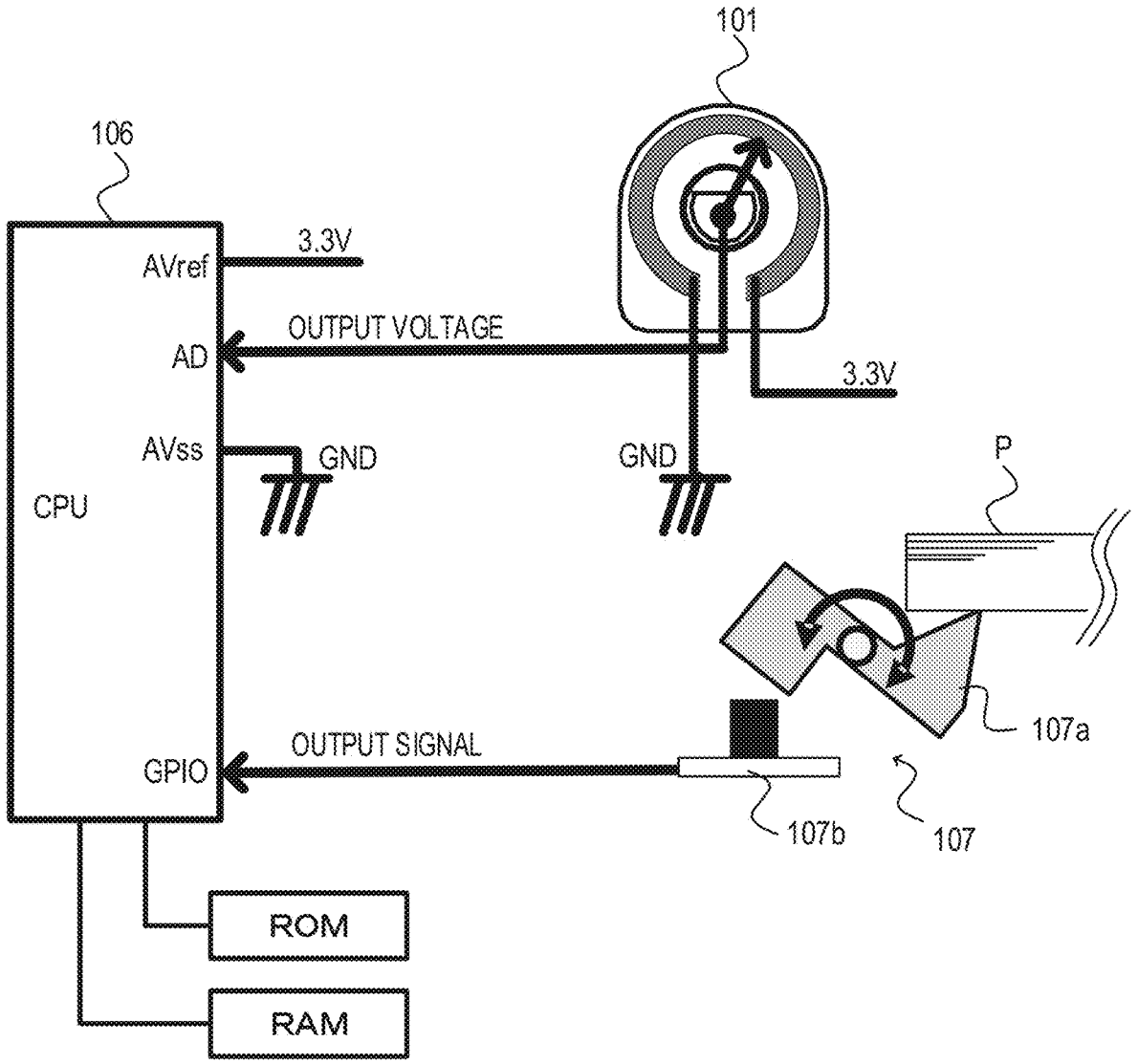
FIG. 7 is a diagram for illustrating a system configuration for detection of a sheet width and presence or absence of a sheet in the first to third embodiments.

FIG. 7 is a diagram for illustrating a system configuration for detection of the width of the sheet P placed in the feed tray 83 in the first embodiment. As illustrated in FIG. 7, the CPU 106 of the control portion includes a ROM and a RAM, which are storage devices. The CPU 106 of the control portion is configured to collectively control an image formation operation of the printer 1 with use of the RAM as a working area based on various control programs stored in the ROM. Further, the CPU 106 includes a timer configured to perform time measurement. The CPU 106 further includes three terminals, specifically, an AVref terminal, an AD terminal, and an AVss terminal. A DC voltage of 3.3 V (volt), which is a maximum value of the output voltage from the width sensor 101, is input to the AVref terminal, and a ground (GND) having a minimum value of the output voltage, which is 0 V, is connected to the AVss terminal. Further, the output voltage corresponding to the rotation angle of the protrusion shaft 101*a* of the width sensor 101 is input to the AD terminal from the width sensor 101 of the sheet-width detection unit 100. The CPU 106 is configured to convert the output voltage (analog voltage) of the width sensor 101 input to the AD terminal, which is an AD conversion input port, into a digital value (AD conversion value) corresponding to the output voltage.

Incidentally, an intended or predetermined dimension of each of the intermediate components provided to transmit the motions of the side regulating plates 82 to the variable resistor of the width sensor 101 and a specification value of the change amount of the resistance value with respect to the movement amount of the variable resistor are known in a stage of designing. Thus, the CPU 106 can uniquely calculate the width of the sheet P based on a mathematical expression (for example, linear equation) using the digital value (AD conversion value) acquired by AD conversion of the output voltage from the width sensor 101 and known parameters such as the intended or predetermined dimension of each of the components and the specification value.

Further, the CPU 106 includes a general-purpose input/output port (GPIO), and an output signal from the sheet sensor 107 is input to the general-purpose input/output port. As illustrated in FIG. 7, the sheet sensor 107 includes the flag portion 107*a* and a switch portion 107*b*. The flag portion 107*a* is configured to detect presence or absence of the sheet P. The switch portion 107*b* is turned on and off by the flag portion 107*a*. When the sheet P is placed in the feed tray 83, an end portion of the flag portion 107*a* on the side for detection of the sheet P is pressed down by the sheet P. As a result, the switch portion 107*b* is brought into an off-state. Meanwhile, when the sheet P in the feed tray 83 runs out, the end portion of the flag portion 107*a* on the side for detection of the sheet P rises (see FIG. 3). As a result, the switch portion 107*b* is brought into an on-state. The CPU 106 is configured to detect presence or absence of the sheet P in the feed tray 83 based on the output signal from the switch portion 107*b* of the sheet sensor 107. Here, the output of the switch portion 107*b* given when the sheet P is present in the feed tray 83 corresponds to the on-state, and the output of the switch portion 107*b* given when the sheet P is absent corresponds to the off-state. However, the outputs may be opposite.

[Detection Method for Sheet Width]

Figure 8:
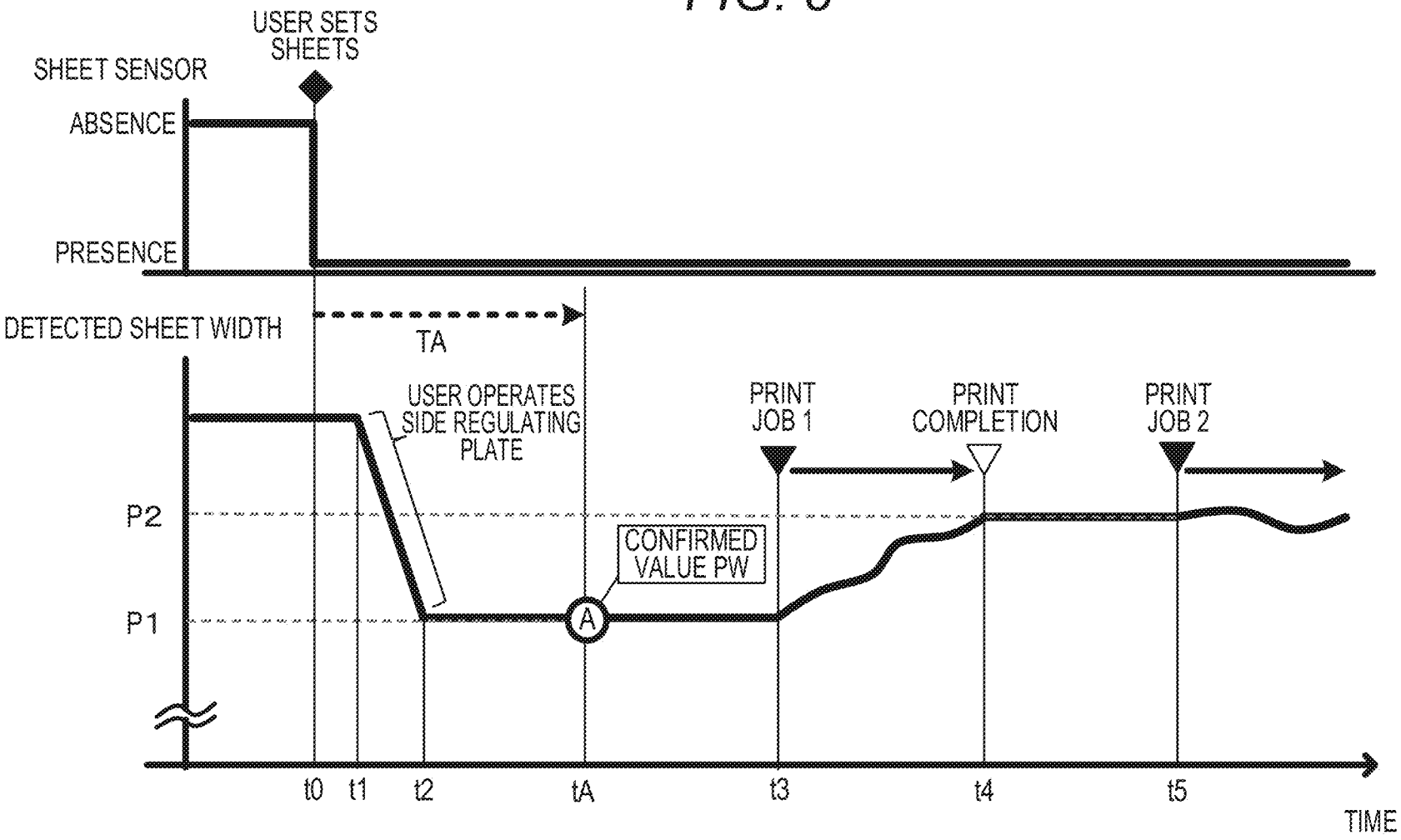
FIG. 8 is a chart for illustrating a detection method for a sheet width of the first embodiment.

Next, with reference to the drawings, a method for detection of the sheet width of the first embodiment is described. FIG. 8 is a chart for illustrating the detection method for the sheet width of the first embodiment. In FIG. 8, the upper chart shows an output signal of the sheet sensor 107, which indicates a state of presence or absence of the sheet P. The lower chart shows a change in sheet width of the sheet P placed in the feed tray 83 based on the output voltage of the width sensor 101. The vertical axis of the upper chart represents the presence or absence of the sheet P detected by the sheet sensor 107. Meanwhile, the vertical axis of the lower chart represents the sheet width of the sheet P placed in the feed tray 83, and the P1 and P2 indicate the sheet width of the sheet P corresponding to a detection value which is the output voltage of the width sensor 101. Further, the horizontal axes of the upper chart and the lower chart represent time, and t0 to t5 and tA each indicate a time (timing).

As mentioned above, in the related-art image forming apparatus, image formation conditions are set based on information of the sheet width detected by the sheet-width detector, and the image formation operation is performed in accordance with the set image formation conditions. Further, when the sheet is set in the feed tray, information of the set sheet is displayed (notified) on a display device of the operation portion based on the information of the sheet width detected by the sheet-width detector.

Meanwhile, in the first embodiment, after elapse of a predetermined time from a change in output signal of the sheet sensor 107 from a signal corresponding to absence of the sheet to a signal corresponding to presence of the sheet, the CPU 106 sets the sheet width of the sheet P corresponding to a detection value A output from the width sensor 101 as a confirmed sheet width PW. Then, the CPU 106 sets the image formation conditions based on the confirmed sheet width PW and performs the printing operation. Further, display on the display portion of the operation portion 109 (also notification of the sheet information to a user) given when the sheet P is set in the feed tray 83 is performed also based on the confirmed sheet width PW. The "image formation conditions" as used herein corresponds to secondary processing conditions for a graphic image, such as a lateral width of the graphic image and an enlargement/reduction ratio of the graphic image. Further, examples of the image formation conditions for the printer 1 of the first embodiment include a processing speed of image formation in the process cartridge 10, an output voltage value of a power supply device (not shown) configured to supply high voltage to the developing device or the like for image formation, and a set temperature for the fixing unit 20 given at the time of image formation.

In FIG. 8, the sheet P is absent in the feed tray 83 before a time t0, and a user places the sheet P having a sheet width P1 in the feed tray 83 at the time t0. Then, the sheet sensor 107 detects that the sheet P is placed, and switches the output signal to the CPU 106 from the signal corresponding to the absence of the sheet (indicated by "ABSENCE" in FIG. 8) to the signal corresponding to the presence of the sheet (indicated by "PRESENCE" in FIG. 8). Then, when it is detected that the output signal from the sheet sensor 107 is changed from the signal corresponding to the absence of the sheet to the signal corresponding to the presence of the sheet, the CPU 106 resets and starts the timer to measure time elapsed from the detection of the signal corresponding to the presence of the sheet. After that, from a time t1 to a time t2, a user moves the side regulating plates 82R and 82L so as to narrow a distance between the side regulating plates 82L and 82R, which have been widened at the time of setting the sheet P, and sandwich the edges of the sheet P in the width direction, which is the direction orthogonal to the conveyance direction of the sheet P, with the side regulating plates 82R and 82L. As described above, in general, when the sheet P is to be set in the feed tray 83, a user sets the sheet P under a state in which the side regulating plates 82 are opened wider than the sheet width of the sheet P to be set. Then, after the sheet P is set in the feed tray 83, the user performs an operation of narrowing the distance between the side regulating plates 82L and 82R such that the distance is adapted to the sheet width of the sheet P.

When the CPU 106 refers to a timer value of the timer and determines that a predetermined time TA (first predetermined time) has elapsed from the time t0 at which the output signal from the sheet sensor 107 is changed from the signal corresponding to the absence of the sheet to the signal corresponding to the presence of the sheet, the CPU 106 performs the following processing. That is, the CPU 106 determines that the sheet width P1 corresponding to the detection value A (encircled A of FIG. 8), which is the output voltage of the width sensor 101, as the sheet width of the sheet P placed in the feed tray 83 and stores the sheet width P1 as the confirmed sheet width PW in the RAM. In the first embodiment, when the CPU 106 once confirms the confirmed sheet width PW, the next timing of updating the confirmed sheet width PW is a timing after elapse of the predetermined time TA from the time at which the output signal of the sheet sensor 107 is changed again from the signal corresponding to the absence of the sheet to the signal corresponding to the presence of the sheet.

It is preferred that the predetermined time TA be a time period longer than the time required for a user to set the sheet P in the feed tray 83 and then complete the operation of narrowing the distance between the side regulating plates 82L and 82R. In general, it is considered that a time period of several seconds is optimum for the predetermined time TA. Through the setting of the predetermined time TA as described above, the confirmed sheet width PW calculated based on the detection value A detected by the width sensor 101 becomes approximately equal to the sheet width P1 of the sheet P.

After that, at a time t3, when a print job 1 is input to the printer 1 from a host computer or the like, the CPU 106 sets the image formation conditions based on the confirmed sheet width PW and starts the printing operation.

In some cases, during a period from the start of the printing operation at the time t3 to the completion of the print job at a time t4, the detection value of the sheet width, which is the output voltage of the width sensor 101, gradually increases from the detection value A corresponding to the sheet width P1 to reach, for example, a detection value corresponding to the sheet width P2. Such phenomenon occurs because of the following reason. It is ideal that, essentially, the sheet P is conveyed straight on a conveyance path. However, in some cases, the sheet P is conveyed in a direction slightly oblique with respect to the conveyance direction. As a result, the sheet P may widen the distance between the side regulating plates 82 (82L and 82R). Further, a vibration or an impact caused by the printing operation may also form a gap between the side regulating plates 82 (82L and 82R) and the sheet P, with the result that the distance between the side regulating plates 82L and 82R is changed.

The printing operation is once completed at the time t4, and the printer 1 is brought into a standby state. Then, when a print job 2 is further input to the printer 1 from the host computer or the like at a time t5, an image forming apparatus using the related-art sheet width detection method mentioned above performs the following processing. That is, the image forming apparatus using the related-art sheet width detection method sets image formation conditions based on the sheet width corresponding to the detection value of the sheet-width detector given at the timing of input of the print job 2 from a host computer or the like, and starts the printing operation. As described above, the processing is performed based on the detection value of the sheet-width detector given under the state in which the gap is formed between the side regulating plates 82 (82L and 82R) and the sheet P, resulting in erroneous setting of the image formation conditions or erroneous notification of sheet information to a user.

Meanwhile, in the first embodiment, during the period from the completion of the printing operation of the print job 1 to the input of the print job 2 from the host computer or the like to the printer 1 at the time t5, the output signal of the sheet sensor 107 is not changed from the signal corresponding to the absence of the sheet to the signal corresponding to the presence of the sheet. Therefore, the sheet width P1 corresponding to the detection value A (encircled A of FIG. 8) output by the width sensor 101 at a time tA remains being set as the confirmed sheet width PW. When the print job 2 is input to the printer 1 from the host computer or the like at the time t5, the CPU 106 sets image formation conditions based the sheet width P1 set as the confirmed sheet width PW, and starts the printing operation. As a result, even when the sheet P widens the distance between the side regulating plates 82 during printing, the value of the confirmed sheet width PW is not changed, and the erroneous setting of the image formation conditions and erroneous notification of the sheet information to a user can be prevented.

In the first embodiment, description has been given of the example case in which the operation of narrowing the distance between the side regulating plates 82L and 82R in accordance with the sheet width of the sheet P is performed after setting the sheet P in the feed tray 83. Also in the case in which the operation of widening the distance between the side regulating plates 82L and 82R in accordance with the sheet width of the sheet P is performed after setting the sheet P in the feed tray 83, the same processing as the case of performing the operation of narrowing the distance between the side regulating plates 82L and 82R is performed. That is, the sheet width detected by the width sensor 101 at the timing after elapse of the predetermined time TA from detection of the placement of the sheet P in the feed tray 83 by the sheet sensor 107 is set as the confirmed sheet width.

As described above, according to the first embodiment, erroneous detection of the sheet width of the sheet placed in the feed tray can be prevented.

Second Embodiment

In the first embodiment, description has been given of the case of setting the sheet width detected by the width sensor at the timing after elapse of the predetermined time from the detection of the placement of the sheet in the feed tray by the sheet sensor as the confirmed sheet width, setting the image formation conditions based on the confirmed sheet width, and performing the printing operation. However, when a user places the sheet in the feed tray and then operates the side regulating plates after elapse of a predetermined time, the sheet width detected by the width sensor after elapse of the predetermined time is not set as the confirmed sheet width. Therefore, the following issue may arise. The sheet width of the sheet placed in the feed tray is not reflected, with the result that the erroneous setting of the image formation conditions cannot be prevented. In a second embodiment, description is given of a setting method for a confirmed sheet width, which addresses the issue described above.

[Detection Method for Sheet Width]

Figure 9:
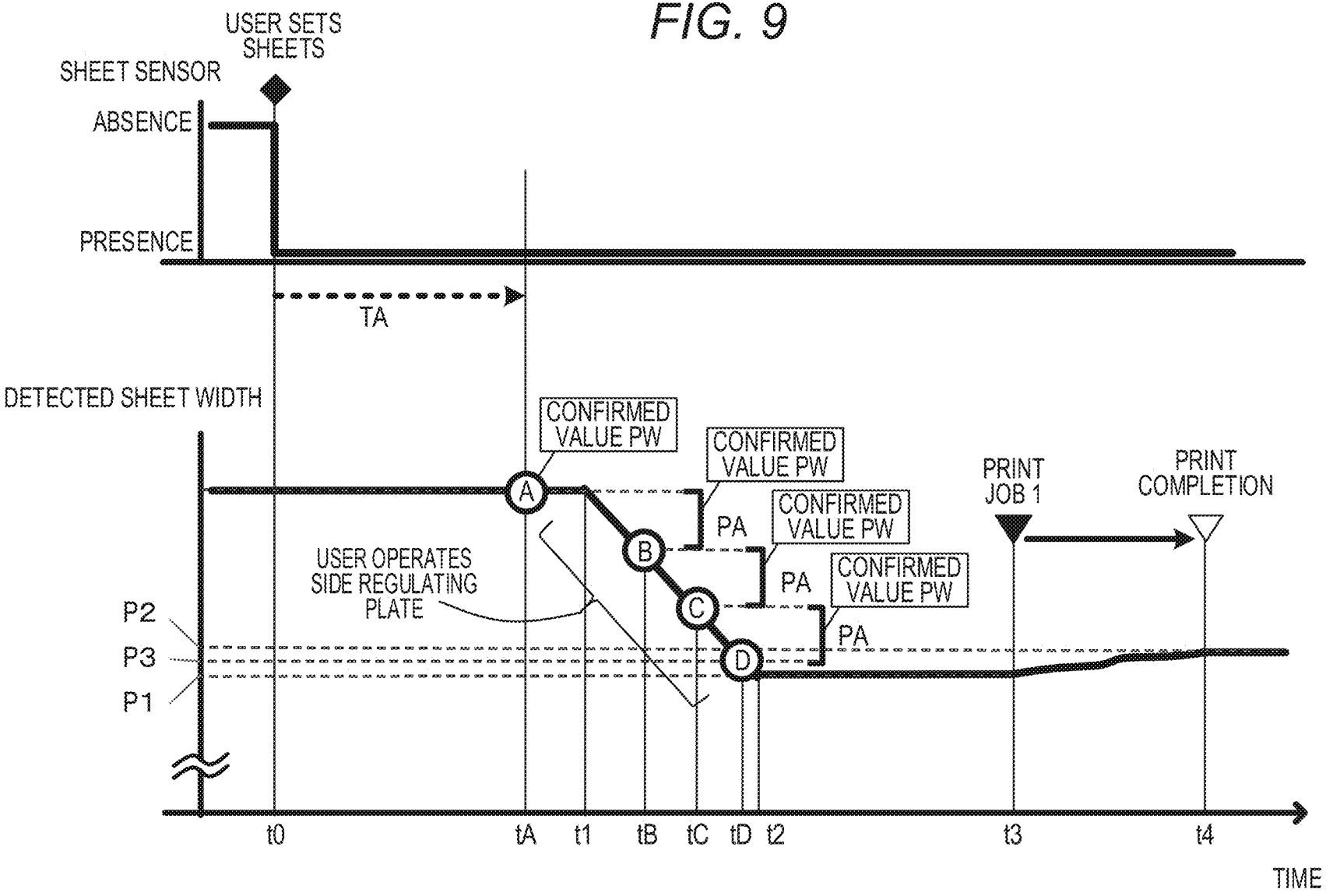
FIG. 9 is a chart for illustrating a detection method for a sheet width of the second embodiment.

Next, with reference to the drawings, a method for detection of the sheet width of the second embodiment is described. FIG. 9 is a chart for illustrating the detection method for the sheet width of the second embodiment. In FIG. 9, similarly to FIG. 8 of the first embodiment, the upper chart shows an output signal of the sheet sensor 107, which indicates a state of presence or absence of the sheet P. The lower chart shows a change in sheet width of the sheet P placed in the feed tray 83 based on the output voltage of the width sensor 101. The vertical axis of the upper chart represents the presence or absence of the sheet P detected by the sheet sensor 107. Meanwhile, the vertical axis of the lower chart represents the sheet width of the sheet P placed in the feed tray 83, and the P1, P2, and P3 indicate the sheet width of the sheet P corresponding to a detection value which is the output voltage of the width sensor 101. Further, the horizontal axes of the upper chart and the lower chart represent time, and t0 to t4 and tA, tB, tC, and tD each indicate a time (timing).

In FIG. 9, the sheet P is absent in the feed tray 83 before a time t0, and a user places the sheet P having a sheet width P1 in the feed tray 83 at the time t0. Then, the sheet sensor 107 detects that the sheet P is placed, and switches the output signal to the CPU 106 from the signal corresponding to the absence of the sheet (indicated by "ABSENCE" in FIG. 9) to the signal corresponding to the presence of the sheet (indicated by "PRESENCE" in FIG. 9). Then, when it is detected that the output signal from the sheet sensor 107 is changed from the signal corresponding to the absence of the sheet to the signal corresponding to the presence of the sheet, the CPU 106 resets and starts the timer to measure time elapsed from the detection of the signal corresponding to the presence of the sheet. After that, when the CPU 106 refers to a timer value of the timer and determines that a predetermined time tA has elapsed from the time t0 at which the output signal from the sheet sensor 107 is changed from the signal corresponding to the absence of the sheet to the signal corresponding to the presence of the sheet, the CPU 106 performs the following processing. That is, the CPU 106 determines that the sheet width corresponding to the detection value A (encircled A of FIG. 9), which is the output voltage of the width sensor 101, as the sheet width of the sheet P placed in the feed tray 83 and stores the sheet width as the confirmed sheet width PW in the RAM.

In the second embodiment, after the sheet width of the sheet P placed in the feed tray 83 is confirmed as the confirmed sheet width PW, the CPU 106 updates the confirmed sheet width PW based on the following two conditions. One condition corresponds to the case in which, similarly to the first embodiment mentioned above, the predetermined time tA has elapsed from the time at which the output signal of the sheet sensor 107 is changed again from the signal corresponding to the absence of the sheet to the signal corresponding to the presence of the sheet. Another condition corresponds to the case in which the sheet width of the sheet P corresponding to the output voltage of the width sensor 101 is smaller than the confirmed sheet width PW by a predetermined sheet width PA.

As mentioned above, in general, it is considered that a time period of several seconds is optimum for the predetermined time TA. When a user finishes moving the side regulating plates 82 to regular positions before elapse of the predetermined time TA, similarly to the first embodiment, the confirmed sheet width PW is approximately equal to the sheet width P1. Here, the regular positions correspond to positions at which the side regulating plates 82L and 82R are brought into abutment against the edges of the sheet P in the width direction. However, when a user does not operate the side regulating plates 82 within the predetermined time TA, the CPU 106 stores the sheet width corresponding to the detection value A (encircled A of FIG. 9) output from the width sensor 101 given at the timing after elapse of the predetermined time TA in the RAM as the confirmed sheet width PW.

After that, as illustrated in FIG. 9, it is assumed that the user operates the side regulating plates 82 such that the side regulating plates 82L and 82R are brought into abutment against the edges of the sheet P, which is placed in the feed tray 83, in the width direction during a period from the time t1 to the time t2. The CPU 106 calculates a sheet width of the sheet P corresponding to the output voltage from the width sensor 101. When it is detected that the calculated sheet width is smaller than the confirmed sheet width PW by the predetermined sheet width PA, the CPU 106 replaces the confirmed sheet width PW with the calculated sheet width to update the sheet width.

As illustrated in FIG. 9, at a time tB, when it is detected that the sheet width of the sheet P corresponding to the output voltage (detection value) of the width sensor 101 is smaller than the confirmed sheet width PW set at the time tA by the predetermined sheet width PA, the CPU 106 performs the following processing. That is, the CPU 106 updates the confirmed sheet width PW with the sheet width corresponding to the detection value B (encircled B of FIG. 9), which is the output voltage of the width sensor 101 detected at the time tB. Further, the CPU 106 may perform processing of subtracting the predetermined sheet width PA from the sheet width set as the confirmed sheet width PW. The same applies to the processing performed at a time tC and a time tD described later.

Subsequently, at the time tC, when it is detected that the sheet width of the sheet P corresponding to the output voltage of the width sensor 101 is smaller than the confirmed sheet width PW set at the time tB by the predetermined sheet width PA, the CPU 106 performs the following processing. That is, the CPU 106 updates the confirmed sheet width PW with the sheet width corresponding to the detection value C (encircled C of FIG. 9), which is the output voltage of the width sensor 101 detected at the time tC.

Further, at the time tD, when it is detected that the sheet width of the sheet P corresponding to the output voltage of the width sensor 101 is smaller than the confirmed sheet width PW set at the time tC by the predetermined sheet width PA, the CPU 106 performs the following processing. That is, the CPU 106 updates the confirmed sheet width PW with the sheet width P3 corresponding to the detection value D (encircled D of FIG. 9), which is the output voltage of the width sensor 101 detected at the time tD. In such a manner, the confirmed sheet width PW which is finally confirmed is set to the sheet width D corresponding to the output voltage of the width sensor 101 detected at the time tD. Here, a difference between the sheet width P3 and the sheet width P1 of the sheet P actually placed in the feed tray 83 becomes smaller than the predetermined sheet width PA. As a result, when the predetermined sheet width PA is set to a small value, the sheet width P3 and the confirmed sheet width PW become approximately equal to the sheet width P1 of the sheet P.

After that, when the print job 1 is input to the printer 1 from the host computer or the like at the time t3, the CPU 106 sets the image formation conditions based the sheet width P3 set as the confirmed sheet width PW, and starts the printing operation. Further, the CPU 106 performs notification of sheet information to a user through the display portion of the operation portion 109 each or every time the confirmed sheet width PW is updated.

In the second embodiment, description has been given of the example case of performing the operation of narrowing the distance between the side regulating plates 82L and 82R and, when the sheet width of the sheet P corresponding to the output voltage of the width sensor 101 becomes smaller than the confirmed sheet width PW by the predetermined sheet width PA, updating the confirmed sheet width PW. Meanwhile, also in the case of performing the operation of widening the distance between the side regulating plates 82L and 82R in accordance with the sheet width of the sheet P, the same processing as in the case of performing the operation of narrowing the distance between the side regulating plates 82L and 82R is performed. That is, the operation of widening the distance between the side regulating plates 82L and 82R is performed, and also when the sheet width of the sheet P corresponding to the output voltage of the width sensor 101 becomes larger than the confirmed sheet width PW by the predetermined sheet width PA, the confirmed sheet width PW is updated.

[Predetermined Sheet Width PA]

The following Table 1 is a table for showing types of sheets which can be printed by the printer 1 and lateral widths of the sheets, which are listed in the descending order in terms of the lateral widths, with differences in lateral width between adjacent sheet types. In Table 1, the column on the left side ("SHEET NAME") includes names of sheets listed in the descending order in terms of the lateral widths, and the column at the center ("LATERAL WIDTH")

includes lateral widths corresponding respectively to the sheet types listed in the column on the left side. The column on the right side ("DIFFERENCE BETWEEN ADJACENT SHEET TYPES") is divided into a sub-column on the left side and a sub-column on the right side. The sub-column on the left side includes a difference in lateral width between a first sheet type (LETTER) and a second sheet type (A4), a difference in lateral width between a third sheet type (16K) and a fourth sheet type (EXECUTIVE), and so on listed from the top. The sub-column on the right side includes a difference in lateral width between the second sheet type (A4) and the third sheet type (16K), a difference in lateral width between the fourth sheet type (EXECUTIVE) and a fifth sheet type (B5), and so on listed from the top. The elements given in "DIFFERENCE BETWEEN ADJACENT SHEET TYPES" which are each surrounded by a bold frame and shaded inside the frame are those having the difference between adjacent sheet types equal to or smaller than 3 mm. With regard to those sheet types, the CPU 106 may erroneously detect the sheet type depending on a state of the gap between the side regulating plates 82 and the edges of the sheet P placed in the feed tray 83 in the width direction. In Table 1, among the differences between the adjacent sheet types, the minimum difference is 1.0 mm. Thus, in order to prevent the erroneous detection of the sheet P placed in the feed tray 83, it is preferred that the predetermined sheet width PA be less than 1.0 mm.

Table 1 is as follows:

| SHEET NAME | LATERAL WIDTH | DIFFERENCE BETWEEN ADJACENT SHEET TYPES | |
|---|---|---|---|
| LETTER | 215.9 mm | 5.9 mm | |
| A4 | 210.0 mm | | 15.0 mm |
| 16K | 195.0 mm | 10.9 mm | |
| EXECTIVE | 184.2 mm | | 2.1 mm |
| B5 | 182.0 mm | 6.0 mm | |
| ENVELOPE B5 | 176.0 mm | | 14.0 mm |
| ENVELOPE C5 | 162.0 mm | 14.0 mm | |
| A5 | 148.0 mm | | 8.3 mm |
| STATEMENT | 139.7 mm | 11.7 mm | |
| B6 | 128.0 mm | | 1.0 mm |
| 2L SIZE | 127.0 mm | 17.0 mm | |
| ENVELOPE DL | 110.0 mm | | 2.1 mm |
| POSTCARD | 108.0 mm | 3.1 mm | |
| ENVELOPE COM10 | 104.8 mm | | 3.2 mm |
| INDEX CARD | 101.6 mm | 1.6 mm | |
| POSTCARD | 100.0 mm | | 1.6 mm |
| ENVELOPE Monarch | 98.4 mm | 9.4 mm | |
| L SIZE | 89.0 mm | | 12.8 mm |
| INDEX CARD | 76.2 mm | | |

As described above, according to the second embodiment, the erroneous detection of the sheet width of the sheet placed in the feed tray can be prevented.

Third Embodiment

In the second embodiment, description has been given to address the following issue. That is, when the sheet is placed in the feed tray, the sheet width detected by the width sensor at the timing after the elapse of the predetermined time is set as the confirmed sheet width. After that, the confirmed sheet width is not updated even when the side regulating plates are operated. In a third embodiment, description is given as a method different from that of the second embodiment.

[Detection Method for Sheet Width]

Figure 10:
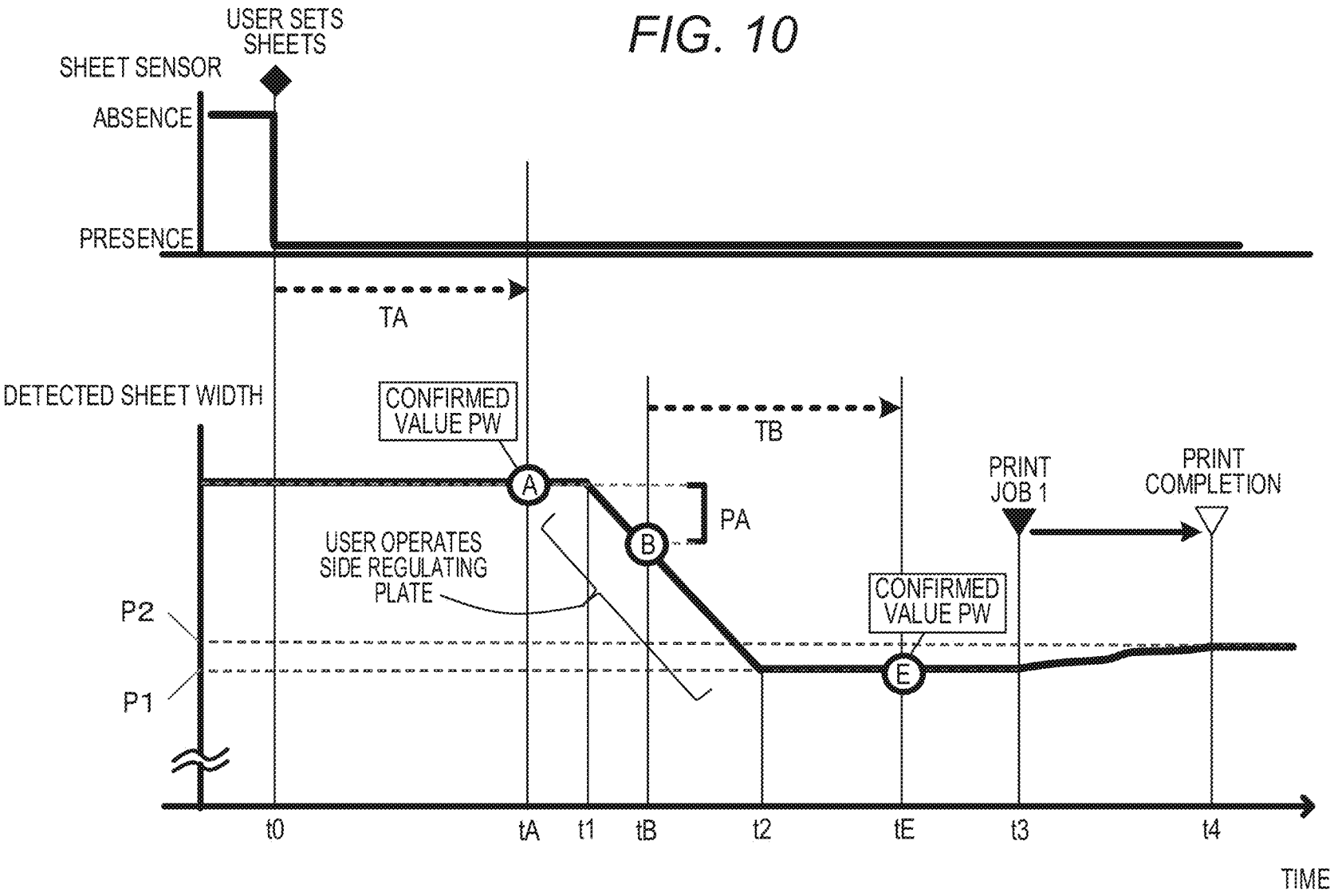
FIG. 10 is a chart for illustrating a detection method for a sheet width of the third embodiment.
Figure 11:
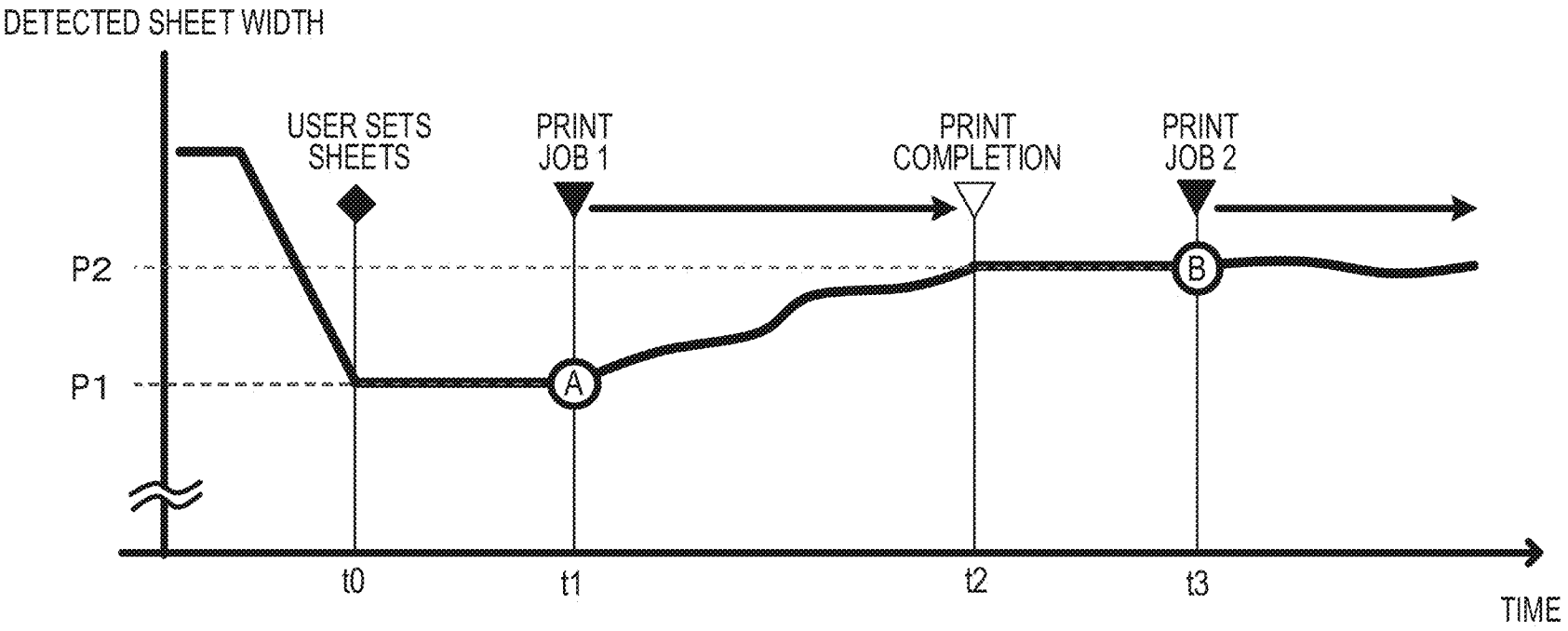
FIG. 11 is a chart for illustrating an output of a sheet-width detector of a related-art example.

FIG. 10 is a chart for illustrating a detection method for the sheet width of the third embodiment. In FIG. 10, similarly to FIG. 8 of the first embodiment, the upper chart shows an output signal of the sheet sensor 107, which indicates a state of presence or absence of the sheet P. The lower chart shows a change in sheet width of the sheet P placed in the feed tray 83 based on the output voltage of the width sensor 101. The vertical axis of the upper chart represents the presence or absence of the sheet P detected by the sheet sensor 107. Meanwhile, the vertical axis of the lower chart represents the sheet width of the sheet P placed in the feed tray 83, and the P1 and P2 indicate the sheet width of the sheet P corresponding to the output voltage (detection value) of the width sensor 101. Further, the horizontal axes of the upper chart and the lower chart represent time, and t0 to t4 and tA, tB, and tE each indicate a time (timing).

In FIG. 10, the processing up to the step in which the CPU 106 stores the sheet width corresponding to the detection value A (encircled A of FIG. 10), which is the output voltage of the width sensor 101, in the RAM as the confirmed sheet width PW is the same as that of the second embodiment, and description thereof is omitted here.

In the third embodiment, after the sheet width of the sheet P placed in the feed tray 83 is confirmed as the confirmed sheet width PW, the CPU 106 updates the confirmed sheet width PW based on the following two conditions. One condition corresponds to the case in which, similarly to the first embodiment mentioned above, the predetermined time tA has elapsed from the time at which the output signal of the sheet sensor 107 is changed again from the signal corresponding to the absence of the sheet to the signal corresponding to the presence of the sheet. Another condition corresponds to the case in which a predetermined time TB (second predetermined time) has elapsed after it is detected that the sheet width of the sheet P corresponding to the output voltage (detection value) of the width sensor 101 is smaller than the confirmed sheet width PW by the predetermined sheet width PA.

After that, as illustrated in FIG. 10, it is assumed that the user operates the side regulating plates 82 such that the side regulating plates 82L and 82R are brought into abutment against the edges of the sheet P, which is placed in the feed tray 83, in the width direction during the period from the time t1 to the time t2. The CPU 106 calculates the sheet width of the sheet P corresponding to the detection value B (encircled B of FIG. 10), which is the output voltage from the width sensor 101. When it is detected that the calculated sheet width is smaller than the confirmed sheet width PW by the predetermined sheet width PA, the CPU 106 resets and starts the timer.

When the CPU 106 refers to a timer value of the timer and detects that the predetermined time TB has elapsed from the time tB to a time tE, the CPU 106 performs the following processing. That is, the CPU 106 determines that the sheet width P1 corresponding to the detection value E (encircled E of FIG. 10), which is the output voltage from the width sensor 101 at the time tE, as the sheet width of the sheet P placed in the feed tray 83, and rewrites the confirmed sheet width PW set at the time tA. As a result, the confirmed sheet width PW becomes approximately equal to the sheet width P1 of the sheet P placed in the feed tray 83.

After that, when the print job 1 is input to the printer 1 from the host computer or the like at the time t3, the CPU 106 sets image formation conditions based on the sheet width P1 set as the confirmed sheet width PW, and starts the printing operation. Further, the CPU 106 also performs the notification of sheet information to the user through the display portion of the operation portion 109 based on the confirmed sheet width PW. The predetermined time TB may be set to a time period equal to the predetermined time TA.

In the third embodiment, description has been given of the example in which, when the sheet width of the sheet P corresponding to the output voltage of the width sensor 101 becomes smaller than the confirmed sheet width PW by the predetermined sheet width PA, the confirmed sheet width PW is updated after elapse of the predetermined time TB. Meanwhile, also when the operation of widening the distance between the side regulating plates 82L and 82R in accordance with the sheet width of the sheet P is performed, and the sheet width of the sheet P corresponding to the output voltage of the width sensor 101 becomes larger than the confirmed sheet width PW by the predetermined sheet width PA, the same processing is performed. That is, also when the operation of widening the distance between the side regulating plates 82L and 82R is performed, and the sheet width of the sheet P corresponding to the output voltage of the width sensor 101 becomes larger than the confirmed sheet width PW by the predetermined sheet width PA, the confirmed sheet width PW is updated after elapse of the predetermined time TB.

As described above, according to the third embodiment, erroneous detection of the sheet width of the sheet placed in the feed tray can be prevented.

Another Embodiment (Feeding Portion of Cassette Feeding Type)

In the first to third embodiments, description has been given of the embodiments in which the present disclosure is applied to the printer 1 including the feeding portion 80 having a configuration called "open tray type", which includes the feed tray 83 provided to the feeding portion 80 and allows a user to directly stack the sheet P in the feed tray 83. Meanwhile, there exists an image forming apparatus including a feeding portion of a cassette feeding type formed of an attachable and detachable feeding cassette. The feeding portion includes, inside thereof, a feed tray and side regulating plates configured to regulate edges of the sheet, which is placed in the feed tray, in the width direction, and sheets are stacked on the feed tray. With the image forming apparatus of this type, a user once draws out the feeding cassette from the image forming apparatus, stacks sheets on the feed tray, and then adjusts the side regulating plates in accordance with the sheet width. Then, the user mounts the feeding cassette to the image forming apparatus again. The image forming apparatus further includes a mounting sensor configured to detect whether the feeding cassette is mounted. The first to third embodiments mentioned above can be applied also to the image forming apparatus including the feeding portion having such a configuration by replacing the detection of the state of presence or absence of the sheet by the sheet sensor 107 with detection of a state of attaching or detaching of the feeding cassette by the mounting sensor.

(Original Reading Device)

In the first to third embodiments, description has been given of the embodiments of allowing the CPU 106 to confirm the sheet width of the sheet P placed in the feed tray 83 of the printer 1 based on the detection value of the width sensor 101 of the sheet-width detection unit 100 and, for example, setting image formation conditions. As mentioned above, the printer 1 includes the reading device 110 configured to read an original. Further, similarly to the side regulating plates 82 and the sheet-width detection unit 100, the original regulating plates 139 configured to regulate edges of the original in the width direction and the original-width detection unit 140 configured to detect a width of the original in a direction orthogonal to the conveyance direction are provided to the original placement table 131 of the reading device 110. Therefore, the CPU 106 is capable of detecting the width of the original placed on the original placement table 131 by performing control similar to those of the first to third embodiments mentioned above through use of the original regulating plates 139 and the original-width detection unit 140. When the read original image is to be printed on the sheet P placed in the feed tray 83, the CPU 106 is capable of setting image formation conditions with use of information of the sheet width detected by the original-width detection unit 140 and performing the printing operation.

As described above, according to the another embodiment, erroneous detection of a sheet width of a sheet placed in the feeding portion of the feeding cassette type or on the original placement table can be prevented.

According to the embodiments described above, erroneous detection of a sheet width of a sheet placed in the feed tray can be prevented.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read-only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2019-127063, filed Jul. 8, 2019, which is hereby incorporated by reference herein in its entirety.

What is claimed is:

1. An image forming apparatus comprising:

a stack portion on which a sheet is to be stacked;

a regulating portion configured to regulate a position of an edge of the stacked sheet;

a first detection device which includes a rotary variable resistor and is configured to output a detection signal based on the rotary variable resistor, wherein the rotary variable resistor is configured to rotate in accordance with the sheet edge position regulated by the regulating portion;

a second detection device including a moving member configured to move in contact with the stacked sheet and a switch portion, wherein a state of the switch portion is changed by the moving member, and wherein the second detection device is located on a downstream side with respect to the regulating portion in a conveyance direction of the sheet and configured to detect presence or absence of the stacked sheet; and a control unit configured to calculate a calculated sheet width of the stacked sheet based on the detection signal output from the first detection device, wherein the regulating portion is movable after the sheet is stacked on the stack portion and the moving member is moved in contact with the stacked sheet, wherein the control unit assumes that a timing when the state of the switch portion is changed by the moving member being moved by the sheet stacked on the stack portion is a starting point and assumes that the calculated sheet width of the sheet, calculated based on the detection signal at a time when a first predetermined time has elapsed from the starting point, is a detected sheet width of the sheet stacked on the stack portion, and wherein the control unit maintains the calculated sheet width on condition that the detection result of the second detection device does not change in a case that the regulating portion is moved by the sheet conveyed after the calculated sheet width is determined.

2. The image forming apparatus according to claim 1, wherein the control unit updates the detected sheet width each time the second detection device detects that a sheet is stacked on the stack portion.

3. The image forming apparatus according to claim 2, wherein, after the first predetermined time has elapsed, the control unit updates the detected sheet width by a predetermined sheet width each time the control unit detects that the calculated sheet width is changed from the detected sheet width by the predetermined sheet width.

4. The image forming apparatus according to claim 3, wherein, the predetermined sheet width is a first predetermined sheet width and, after the first predetermined time has elapsed and in a case in which the control unit detects that the calculated sheet width is changed from the detected sheet width by a second predetermined sheet width, the control unit sets the calculated sheet width when a second predetermined time has elapsed from a timing at which the control unit detects that the calculated sheet width is changed by the second predetermined sheet width as the detected sheet width.

5. The image forming apparatus according to claim 4, wherein the second predetermined time is equal to the first predetermined time.

6. The image forming apparatus according to claim 2, wherein, after the first predetermined time has elapsed, the control unit reduces the detected sheet width by a predetermined sheet width each time the control unit detects that the calculated sheet width is smaller than the detected sheet width by the predetermined sheet width.

7. The image forming apparatus according to claim 2, wherein, after the first predetermined time has elapsed and in a case in which the control unit detects that the calculated sheet width is smaller than the detected sheet width by a predetermined sheet width, the control unit sets the calculated sheet width when a second predetermined time has elapsed from a timing at which the control unit detects that the calculated sheet width is smaller than the predetermined sheet width as the detected sheet width.

8. The image forming apparatus according to claim 7, wherein the second predetermined time is equal to the first predetermined time.

9. The image forming apparatus according to claim 1, wherein the regulating portion includes:

a first regulating member configured to regulate a position of one edge of the sheet in a width direction orthogonal to the conveyance direction of the sheet, and a second regulating member configured to regulate a position of another edge of the sheet in the width direction by moving in a direction symmetrical to an operation direction of the first regulating member.

10. The image forming apparatus according to claim 9, further comprising a rack coupled to the first regulating member and configured to move integrally with the first regulating member, wherein the first detection device includes a gear having teeth meshed with teeth of the rack in order to detect the detected sheet width, wherein the rotary variable resistor includes a shaft coupled to the gear, wherein a resistance value of the rotary variable resistor is changed in accordance with a rotation angle of the shaft, and wherein the first detection device is configured to output a voltage in accordance with the resistance value of the rotary variable resistor as the detection signal.

11. The image forming apparatus according to claim 10, wherein the control unit is configured to calculate the calculated sheet width of the stacked sheet with use of the voltage output from the first detection device and a linear equation using the voltage.

12. The image forming apparatus according to claim 1, wherein the stack portion is provided with the second detection device.

* * * * *